United States Patent [19]

Haggett

[11] Patent Number: 4,498,898

[45] Date of Patent: Feb. 12, 1985

[54] CENTRIFUGAL SEPARATOR

[75] Inventor: Mervyn T. Haggett, Langport, England

[73] Assignee: AE PLC, Warwickshire, England

[21] Appl. No.: 485,651

[22] Filed: Apr. 18, 1983

[30] Foreign Application Priority Data

Apr. 16, 1982 [GB] United Kingdom ..... 8211100

[51] Int. Cl.[3] ..... B04B 9/06

[52] U.S. Cl. ..... 494/49; 494/24

[58] Field of Search ..... 494/7, 24, 27, 31, 36, 494/49, 56, 84; 210/171, 375, 374, DIG. 17, 340, 341

[56] References Cited

U.S. PATENT DOCUMENTS

| | | | |
|---|---|---|---|
| 3,432,091 | 3/1969 | Beazley | 494/49 |
| 3,762,633 | 10/1973 | Ishii | 494/49 |
| 3,784,092 | 1/1974 | Gibson | 494/49 |
| 3,914,176 | 10/1975 | Holmes | 210/340 |
| 4,106,689 | 8/1978 | Kozulla | 494/49 |
| 4,165,032 | 8/1979 | Klingenberg | 494/49 |
| 4,192,750 | 3/1980 | Elfes et al. | 210/340 |
| 4,284,504 | 8/1981 | Alexander et al. | 494/49 |
| 4,346,009 | 8/1982 | Alexander et al. | 494/49 |

*Primary Examiner*—Robert W. Jenkins

*Attorney, Agent, or Firm*—Pearne, Gordon, Sessions, McCoy, Granger & Tilberry

[57] ABSTRACT

A centrifugal oil cleaner assembly adapted to be mounted on a support at its upper end and to depend from the support, the assembly comprising a first housing member, a second housing member sealingly engageable with the upper end of the first housing member to form a chamber, a substantially vertical shaft mounted in the chamber, a rotor carried by the shaft and within the chamber, the shaft serving to releasably secure the first housing member to the second housing member by means of a screwthread connection and to carry the weight of the first housing member and the rotor, means for supplying oil to be cleaned under pressure through the second housing member to the interior of the rotor, said means including a passageway in the upper end of the shaft, jets to discharge oil from the rotor into the chamber and by reaction cause the rotor to rotate, and an oil outlet for removing oil from the chamber. Such an arrangement permits rapid and easy replacement of a disposable rotor in a separator of the type suspended by its upper end.

8 Claims, 8 Drawing Figures

CENTRIFUGAL SEPARATOR

This invention relates to centrifugal separators for separating contaminants from contaminated fluids, and particularly for extracting solid matter from oil or other fluids or for separating a heavier fluid from a lighter fluid (for example, water from fuel oil). Such separators include a rotatable drum (rotor) through which fluid is fed so that during the period when a part of the fluid remains in the drum it is subjected to centrifugal action caused by the rotation. This causes solid matter in the fluid or the heavier of the two fluids to be separated and be retained around the circumferential wall of the drum while the "cleaned" fluid is taken to where it is required for use. The drum is provided with one or more outlet nozzles through which fluid leaves the interior of the drum, the fluid issuing from the nozzles with a substantially tangential component with respect to the drum whereby the drum is caused to rotate by the reaction of the jets of fluid issuing from the nozzles. Such a centrifugal separator will hereinafter be referred to as "of the kind described".

The invention has particular application to the cleaning of lubricating oil in internal combustion engines, particularly such engines in trucks, lorries and other vehicles. Although centrifugal separators of conventional type have been used for this purpose, oil filters are more widely employed. However conventional fluid filters, such as oil filters having paper elements, are basically mechanical strainers which include a filter element having pores which trap and segregate dirt from the fluid. Since the flow through the filter is a function of the pore size, filter flow will decrease as the filter pack becomes clogged with dirt. As the filtration system must remove dirt at the same rate at which the dirt enters the oil, a clogged conventional paper element filter cannot process enough oil to keep the dirt level of the oil at a satisfactory level. A further disadvantage of some mechanical strainer type filters is that they tend to remove oil additives. Furthermore, the additives may be depleted to some extent by acting upon trapped dirt in the filter instead of on a working surface of an engine as intended.

Conventional centrifugal separators of the kind described must be dismantled for cleaning out the drum when it is nearly full of contaminants. This cleaning process involves a relatively expensive construction of drum capable of being repeatedly readily opened up for cleaning and readily reassembled with tightly sealed joints.

Thus while centrifugal separators have an undoubtably superior performance to element type filters the need to be cleaned out has up till now necessitated a complicated construction with relatively heavy machined castings so that it will stand up to periodic cleaning to remove the sludge built up. This has probably militated against the more universal use of centrifugal separators in engines. It has also not been possible to provide an effective warning system to show that the drum is full which further complicates the problem of maintenance.

The invention is particularly concerned with improvements in centrifugal separators of the kind described such that either the separator is a low cost product which may be disposed of in its entirety and replaced with a new unit or the separator is such that a low cost drum can be readily removed and replaced.

Thus in one form the invention provides a centrifugal separator for cleaning oil in a vehicle internal combustion engine, which is wholly disposable after the vehicle has done a certain mileage and which is very similar as regards external appearance and fitting and size to a conventional automative spin-on engine block canister filter. To be wholly disposable the separator should be of simple and low cost construction avoiding expensive machined parts and the total number of parts should be kept to a minimum. In another and more preferred form of the invention only the drum is replaced.

A wholly disposable centrifugal separator is described in U.S. Pat. No. 4,106,689 (Kozulla) and a separator with a replaceable drum or rotor is described in U.S. Pat. No. 3,762,633 (Ishii).

Modifications of the Kozulla centrifugal separator have already been described in U.S. Pat. No. 4,288,030 (Beazley et al) and U.K. Pat. No. 2 049 494. U.S. Pat. No. 3,784,092 (Gibson) discloses a centrifugal separator with a two part casing held together apparently by means of the rotor shaft and having oil inlet means at the top of the shaft. However, the separator is not of the top mounted type and the rotor is not disposable.

However, it has now been found that a novel method of constructing the separator and mounting it on the engine permits one either to replace the whole separator or to replace only the rotor.

In accordance with one aspect of this invention we provide a centrifugal separator wherein the outer casing or shroud is open-topped and is suitable for engagement with a closure member by means of which the separator may be supported in use, the separator shaft being releasably connected to the closure member. Alternatively, the shaft may be releasably connected to the main part of the separator at its lower end such that it remains fixed to the closure member when the separator is disassembled.

Preferably the upper end of the shaft is screw threaded for engagement with a screw thread provided by the closure member. It is also preferred that the releasable connection of the shaft and the closure member provides substantially the sole means of holding the closure member and the shroud together.

The closure member may for example be a plate and may sealingly engage the shroud either with its lower face or with its peripheral face. In the first case the upper end of the shroud may be stepped outwardly to provide an upward-facing channel for an annular seal of elastomeric material. In the latter case an annular elastomeric seal may be lodged in a circumferential groove in the closure member such that the closure member sealingly fits into the top of the shroud.

The closure member may be a lid associated with the shroud and removable from the engine with the shroud; it may be a similar lid with the difference that it is designed to remain behind in the engine mounting when the separator is removed; or it may be part of the mounting itself (which will normally be a metal casting). The third alternative is satisfactory but requires a new casting. The second alternative is similar to the third but the closure member is an adaptor for modifying an existing casting; and the first alternative provides an arrangement in which the separator need not be opened up till it has been removed from the engine mounting—this may be convenient in some circumstances.

Embodiments of the invention will now be described with reference to the accompanying drawings in which.

Figure 1:
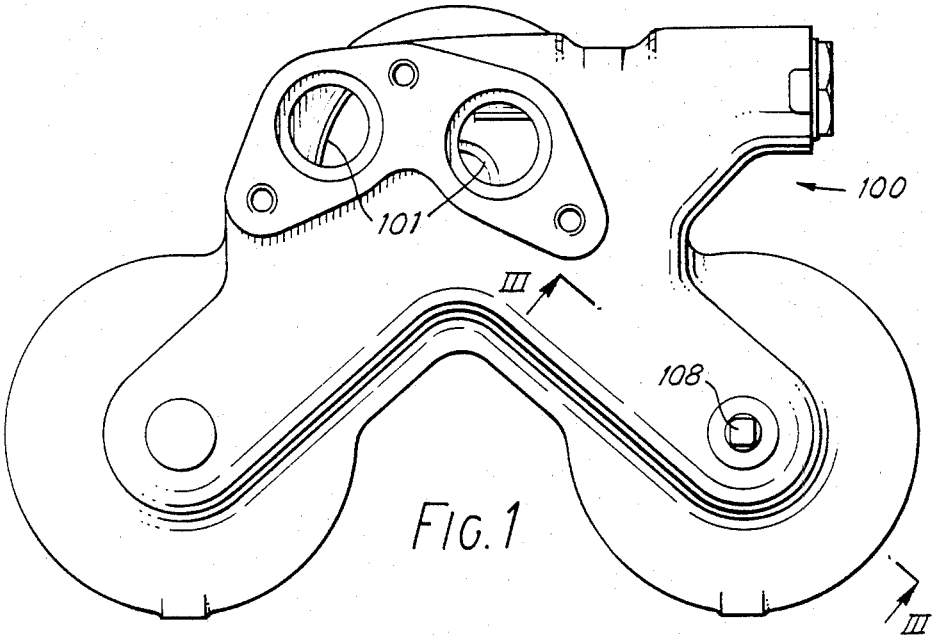
FIG. 1 is a top plan view of a slightly modified prior art commercial manifold casting originally designed for mounting three depending element type filters on a heavy vehicle engine.
Figure 2:
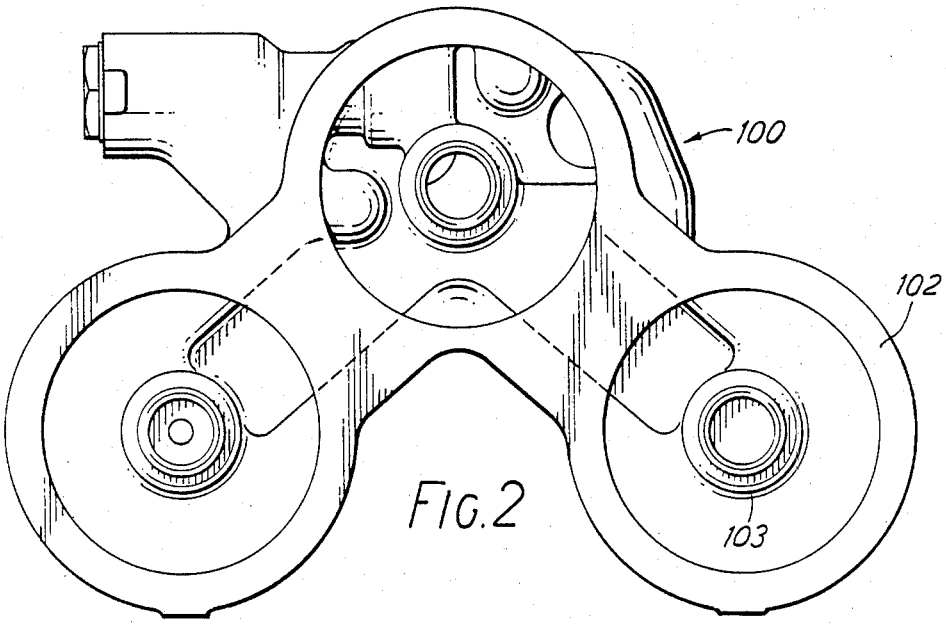
FIG. 2 is an under plan view of the casting of FIG. 1.
Figure 3:
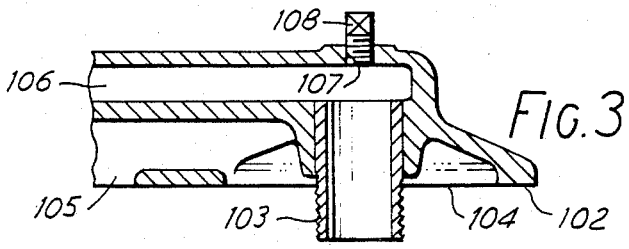
FIG. 3 is a section on line III—III of FIG. 1.

The manifold casting 100 shown in FIGS. 1–3 is attached to the engine and has oil inlet and outlet ports 101. For mounting each conventional filter there is a downward facing annular sealing surface 102 and a central screw-threaded boss 103 onto which the filter is screwed so that it is supported by the boss 103 and seals against the surface 102. Turning more specifically to FIG. 3, for a conventional element-type filter, oil is fed into the filter through an annular space 104 between the surface 102 and the boss 103. The space 104 is connected via a passage 105 to one of the ports 101. Cleaned oil is returned via the boss 103 and a passage 106 connected to the other of the ports 101.

For a centrifugal separator the oil feed should be through the boss 103. In one method of adaptation, passage 106 is sealed off and oil is fed through a hole 107 (shown with a plug 108 in it in the drawing). In another method of adaptation the upper end of boss 103 is closed off and one or more radial ports are provided in the boss 103 (or an equivalent part to be described below) to connect its interior with space 104. A pair of diametrically opposite holes may also be useful for insertion of a tommy bar for removal of the boss and an associated plate as described below.

In this connection, it should be noted that centrifugal separators are generally of the by-pass type such that only a proportion of the oil supplied by the engine oil pump passes through the separator during each circulation cycle. On the other hand, element-type filters are generally full flow filters.

Figure 4:
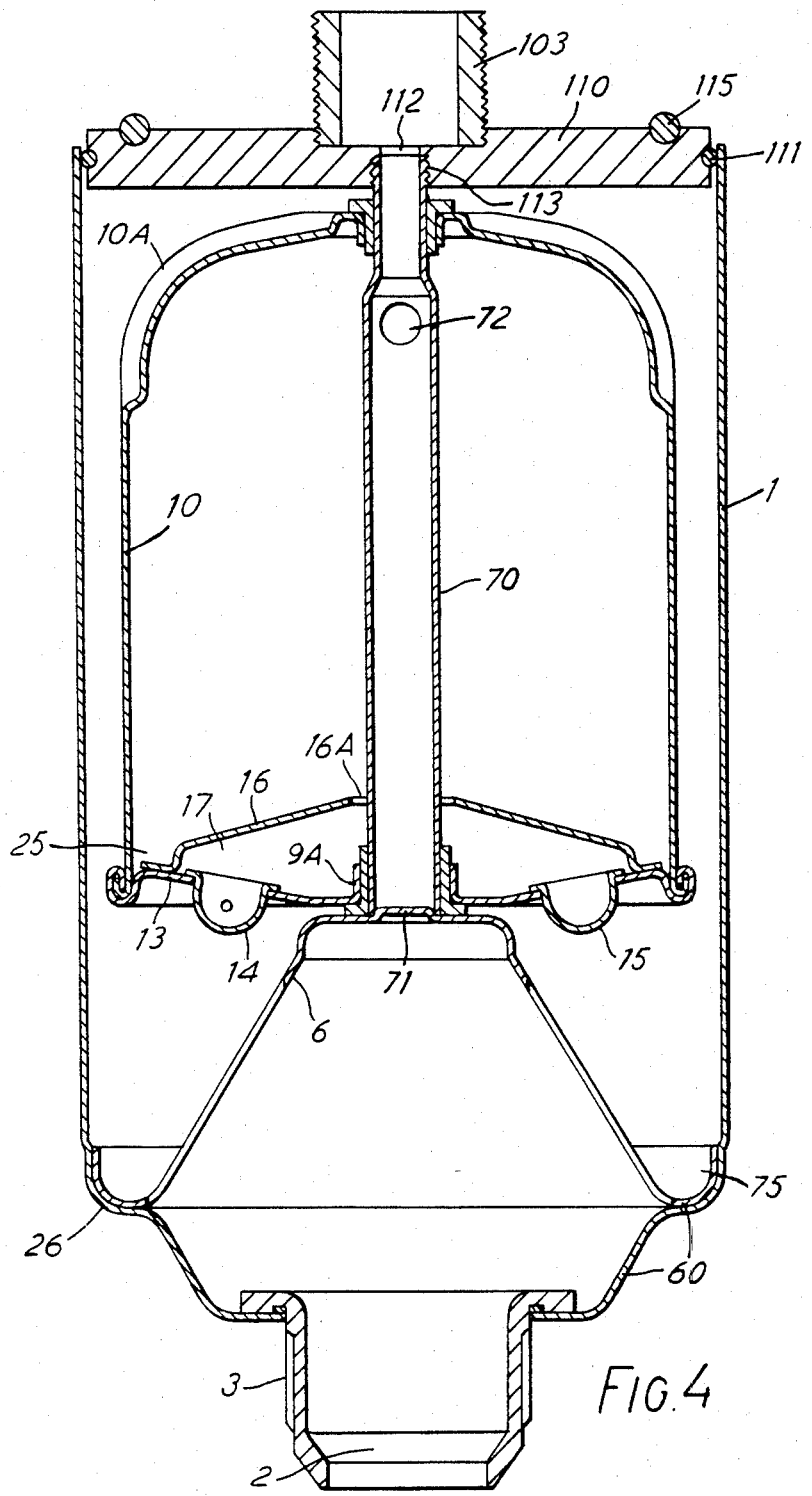
FIG. 4 is a vertical section through a centrifugal separator of the invention.
Figure 5:
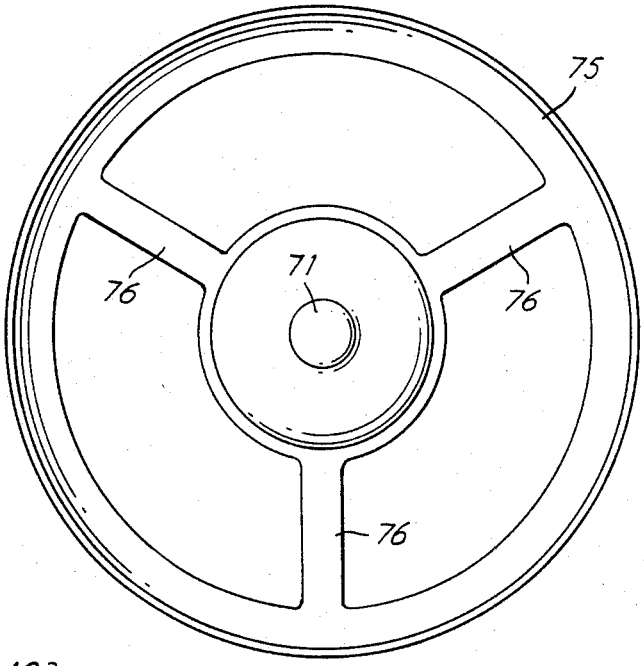
FIG. 5 is a plan view of the spider used in the FIG. 4 separator.

Referring now to FIG. 4, there is shown a centrifugal separator which is basically similar to that shown in FIG. 3 of our U.K. Pat. No. 2 049 494. The separator comprises a pressed out sheet metal outer canister 1 having a union 3 providing an oil outlet 2 from which oil is led away to the engine via a flexible oil return pipe (not shown). A central hollow shaft or spindle 70 is rigidly and securely mounted at its lower end on a spider 6 (shown more clearly in FIG. 5). For example the shaft 70 may fit over and be welded or otherwise secured to a projection 71 on the spider 6. The spider 6 has a peripheral channel 75 welded or otherwise secured to the upper part of a ledge 60 in the canister 1 and has three arms 76 providing three spaces through which oil may pass downwardly to the outlet 2. The channel 75 is open on the inside between the arms 76.

A pressed metal rotor canister 10 is freely rotatably mounted on the shaft 70 via upper and lower annular bearing members of L-shaped section. Strengthening ribs 10A are formed in the rotor 10. The lower end of the rotor canister 10 is provided by a pressed out plate 13 which includes two pressed out tangential nozzle outlets 14 and 15. A further plate 16 spaced from the nozzle plate 13 provides a nozzle chamber 17 into which the oil passes through an annular gap 16A adjaced the shaft 70. A peripheral sludge collecting channel 25 is provided, which in combination with the outwardly sloping plate 16 serves to reduce the likelihood of dirt entering the nozzle chamber 17. Oil is fed to the rotor canister 10 from the inside of the shaft 70 via a lateral port 72 in the shaft.

As shown in FIG. 4 the canister 1 is open-ended but is closed by a closure plate or lid 110. The plate 110 has a circumferential groove housing a seal 111 which engages the upper end of the canister 1 when the plate 110 is fitted therein as shown. The plate 110 has a central bore 112 for supplying oil to the shaft 70 and an enlarged tapped counterbore 113 which mates with a male thread on the upper end of shaft 70. The plate 110 is thus secured in position by being screwed onto the shaft 70 until the shaft 70 reaches the bottom of counterbore 113. A boss 103 corresponding to boss 103 of FIG. 3 is inset into the plate 110 and welded or otherwise secured therein.

Thus if the boss 103 of FIG. 3 is connected to the casting 100 by a screwthread as is normally the case, it can be removed leaving a female thread for receiving the boss 103 of FIG. 4. A seal 115 in a groove in the top face of the plate 110 is arranged to seal against the surface 102.

If it is desired to replace the rotor 10, this can be achieved either by unscrewing the boss 103 from the casting, removing the whole separator from the engine and removing the plate 110 on a workbench, or simply by unscrewing the shaft 70 from the plate and leaving the plate 110 and its boss 103 in situ in the engine.

Figure 6:
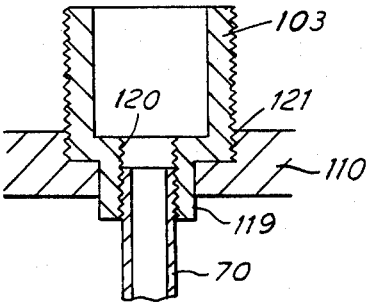
FIG. 6 shows a modification of part of FIG. 4.

In the FIG. 6 embodiment the boss 103 is modified to give a small diameter downward extension 119 with an internal thread 120. The main part of the boss 103 is screwed into a tapped counterbore 121 in the upper face of plate 110 and the shaft 70 is screwed into the extension 119.

Figure 7:
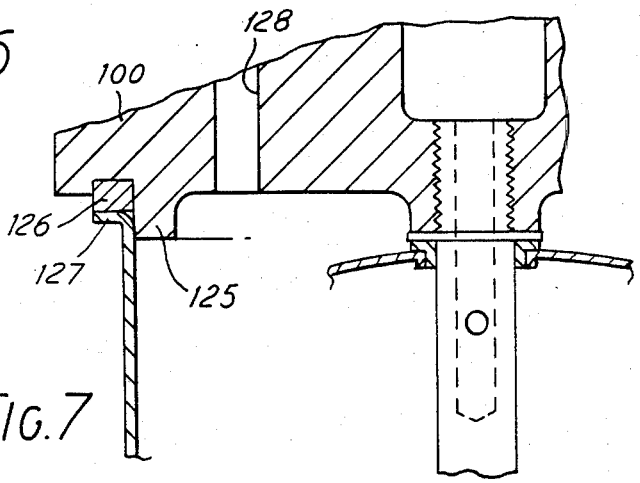
FIG. 7 shows a second modification of part of FIG. 4.

In the FIG. 7 embodiment a slightly modified casting 100 provides the lid of the separator and the plate 110 is omitted. The casting 100 has an annular ridge 125 and an associated seal 126 which engages a ledge 127 formed at the top of canister 1. The top of shaft 70 screws into the casting 100 either directly or via an internally and externally threaded bush or insert located in a tapped hole in the casting. As shown the interior of the separator may be vented by a passage 128 in the casting 100.

In an alternative embodiment (not shown) the shaft 70 remains attached to the casting when the canister 1 is removed. This may be achieved by making its lower end screw threaded and screwing it into a captive nut on the spider 6.

Figure 8:
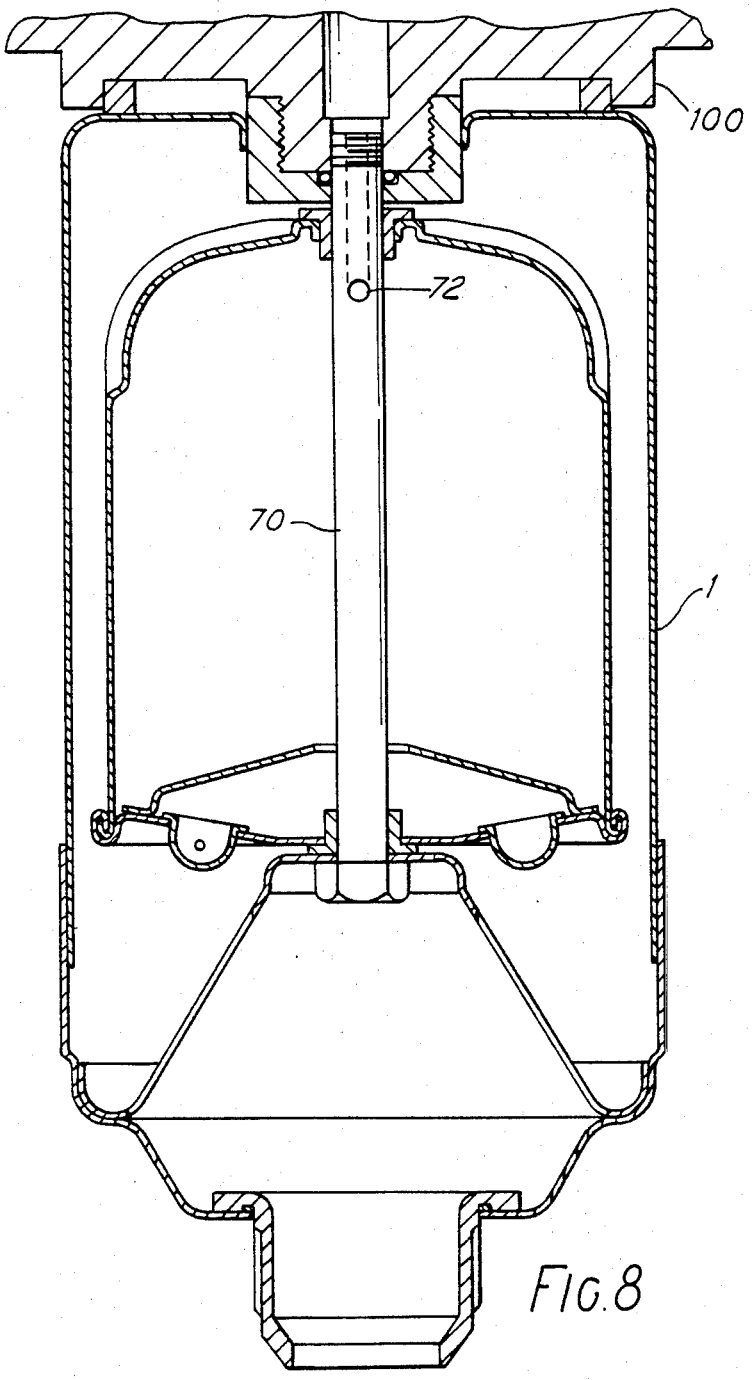
FIG. 8 shows a further modification of FIG. 4.

In a further alternative shown diagrammatically in FIG. 8, the canister 1 has a telescopic joint (with a suitable seal—not shown) adjacent its lower end so that its upper end remains permanently fixed to the casting 100. The shaft 70 may thus be unscrewed by rotating the lower part of the canister 1 with a chain wrench. Alternatively the shaft 70 may be in the form of a bolt passing through the spider with a head abutting its underside. This bolt may be screwed up or unscrewed using a suitable tool inserted through the outlet union.

Experiments have shown that with an engine which conventionally uses three full-flow element-type filters, the best arrangement is two full-flow element-type filters and one centrifugal separator. An arrangement where there is only one filter and only one separator is not so effective.

The centrifugal separator described herein may be adapted to incorporate an air purging system as described in U.S. patent application Ser. No. 340,884 (Woods Martin) and in corresponding U.K. Patent Application No. 8301240, the contents of which are incorporated herein by reference.

I claim:

1. A centrifugal oil cleaner assembly adapted to be mounted on a support at its upper end and to depend from the support, the assembly comprising a housing member having a bottom portion defining an outlet and sidewalls extending upwardly therefrom to define an open upper end, closure means on said support sealingly engageable with said open upper end of said housing member to form a chamber, a substantially vertical shaft mounted in said chamber, a rotor journaled on said shaft within said chamber and having an interior chamber, said shaft serving to releasably secure said housing member to said support and to carry the weight of said housing member and said rotor, means for supplying oil to be cleaned under pressure through said shaft to the interior of said rotor, said means including a passageway in the upper end of said shaft, and jets on said rotor to discharge oil from the interior of said rotor into said chamber and by reaction cause said rotor to rotate.

2. An assembly according to claim 1, wherein said rotor is removable through said open upper end when said housing member is disconnected from said support.

3. An assembly according to claim 1, wherein said closure means is a separate plate secured to said support.

4. An assembly according to claim 3, wherein said shaft has a screw thread connection with said plate.

5. An assembly according to claim 1, wherein said closure means is an integral portion of said support.

6. An assembly according to claim 1, wherein said support has means for mounting at least one other oil cleaner.

7. An assembly according to claim 1, wherein said shaft has a screw thread connection with said support.

8. An assembly according to claim 7, wherein said shaft comprises a bolt with a head at its lower end, said head being rotatable by a tool inserted through said outlet.

* * * * *